United States Patent [19]

Stillman et al.

[11] 4,372,597

[45] Feb. 8, 1983

[54] SUBMERSIBLE EQUIPMENT HANDLING SYSTEM

[75] Inventors: Gordon B. Stillman, Liverpool; Charles R. White, Manlius, both of N.Y.

[73] Assignee: General Electric Company, Syracuse, N.Y.

[21] Appl. No.: 174,406

[22] Filed: Aug. 24, 1971

[51] Int. Cl.[3] ..... B66C 1/00

[52] U.S. Cl. ..... 294/67 DA; 294/81 SF

[58] Field of Search ..... 294/67 DA, 81 SF

[56] References Cited

U.S. PATENT DOCUMENTS

| | | | |
|---|---|---|---|
| 3,086,807 | 4/1963 | Russell et al. | 294/67 DA |
| 3,148,909 | 9/1964 | Tantlinger | 294/81 SF |
| 3,191,983 | 6/1965 | Gaglione | 294/81 SF |
| 3,262,729 | 7/1966 | Willison et al. | 294/81 SF |
| 3,675,960 | 7/1972 | Mangold | 294/81 SF |

*Primary Examiner*—David H. Brown

*Attorney, Agent, or Firm*—Carl W. Baker; Richard V. Lang

[57] ABSTRACT

A handling system for lowering and retrieving large and heavy objects such as sonar arrays from surface ships and other unstable platforms. A submersible object which normally is suspended by a single cable when at operating depth is retrieved and returned to a surface platform by a messenger device suspended on two or more other cables from the platform and provided with means for guiding the messenger to the object, orienting the object with respect to the messenger and thus with respect to the surface platform, and locking the messenger and object together. The resulting messenger and object assembly then may be hoisted back to the platform with some or all of the weight of the assembly carried by the messenger cables thus at least partially unloading the main support cable during retrieval.

7 Claims, 7 Drawing Figures

SUBMERSIBLE EQUIPMENT HANDLING SYSTEM

BACKGROUND OF THE INVENTION

The invention herein described was made in the course of or under a contract or subcontract thereunder, with the United States Navy.

The present invention relates generally to marine equipment handling systems and more particularly to such systems for lowering and retrieving bulky and heavy objects from ships and other unstable surface platforms.

In oceanographic work it often is necessary to deploy large and bulky objects from surface vessels for purposes of underwater exploration, observation or the like, and subsequently to retrieve the objects to, and sometimes into, the vessel from which deployed. For example, surveilance sonar systems may employ sonar transducer arrays which are very large in size and very substantial in weight, of the order of many thousands of pounds. Such arrays may conveniently be tethered by a single support line even to a relatively unstable surface platform such as a ship, during deployment and normal operation of the array at depth. During deployment the cable may be paid out sufficiently freely that even abrupt relative motion between the ship and array will not unduly load the cable, and when the array is at its operating depth which typically may be some thousands of feet, the inherent resilience of such long length of cable will permit heaving and other ship motion with respect to the array without excessive loading of the cable and without transmittal of sufficient force loading to the array as to cause it to attempt to follow the ship motion.

During retrieval of such arrays, however, several problems arise. As the array is hoisted upwardly into close proximity with the ship, the short length of cable remaining between the ship and array has too little resilience to permit any substantial relative motion between them, and the array accordingly is constrained to attempt to follow vertical motion of the ship. The resultant extreme fluctuations in loading on the cable may well exceed its strength, causing loss of the array. Also, if as is often the case the array is to be winched into engagement with the ship or into a well or hold formed within the ship, it is necessary that the array be placed into and held in proper orientation with respect to the ship at the moment of contact. Use of heavier cable can be of little if any help on this latter problem, of course, and is of limited benefit even with respect to the cable overload problem because generally cable strength can be improved only at the expense of cable weight, and where extremely long lengths of cable are required the cable weight itself may become the major part of the load and thus become the limiting factor.

SUMMARY OF THE INVENTION

The present invention has as its principal objective the provision of safe, reliable and relatively low cost systems for retrieval of submersible objects such as sonar arrays operating from an unstable surface platform. The system requires only passive devices to enable automatic location, positioning and alignment, latching and loading of the submersible object during retrieval operations, and provides the desired visibility to operators on shipboard indicating that capture and retrieval of the object is progressing in safe and orderly manner.

In the exemplary embodiment hereinafter particularly described, the submersible object is a large sonar array which is tethered to a surface ship by a single winch-operated main support line during the launch operation, during sonar operation at depth, and during retrieval back to a point approximately one or two hundred feet below the bottom of the ship. At this point, at which the ship's motion may begin to load the cable excessively, a retrieval or messenger device is lowered to the array by means of two cables paid out from the ship. The messenger cables are in line with the roll axis of the ship, and the messenger is centered with respect to the array cable by means of a centering device which engages and travels along the array main support line. The array and messenger are provided with cooperating ramp and follower elements which serve automatically to align the messenger and array angularly as they come vertically together, and the array and messenger also include cooperating latch elements which operate automatically upon attainment of the proper angular orientation of the messenger and array to lock them together. The combined load of the messenger and array then is taken up by the messenger cables, and the assemblage thus constituted is hauled upwardly to or into the ship. During this phase of the recovery the array main support line is unloaded either partially or completely as preferred.

BRIEF DESCRIPTION OF THE DRAWINGS

The foregoing and other objects, features and advantages of the invention will become more fully apparent and the invention be further understood by reference to the following detailed description when read in conjunction with the accompanying drawings, wherein.

DESCRIPTION OF THE PREFERRED EMBODIMENT

Figure 1:
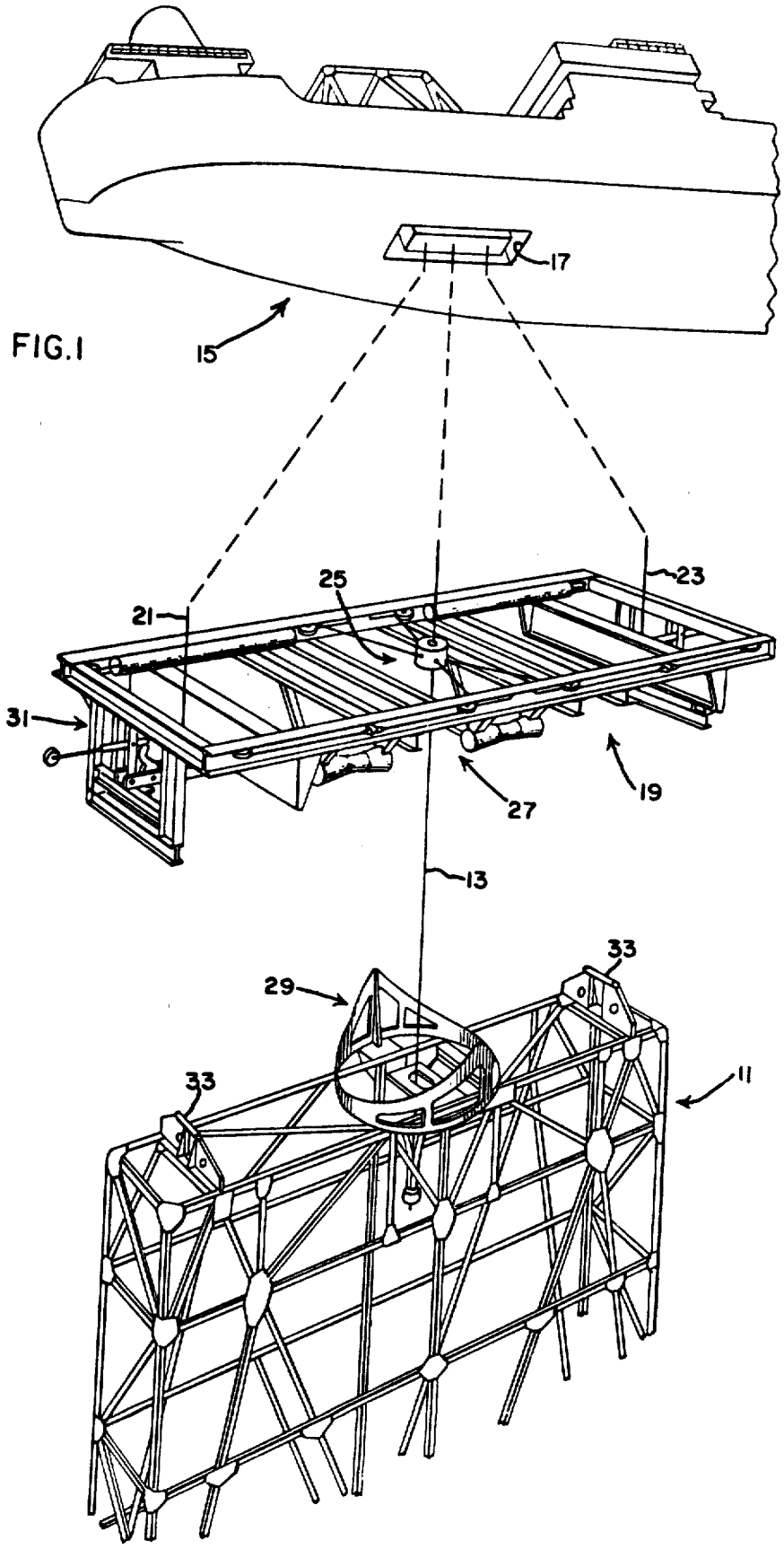
FIG. 1 illustrates the marine handling system of the invention as applied to a ship-carried sonar array.

As previously indicated, the marine equipment handling system of the present invention has application to a variety of oceanographic and other underwater equipments such as ocean bottom environmental capsules, drilling and sampling apparatus, sonars and the like. As illustrated in FIG. 1 the invention is shown applied to a surveillance sonar array the supporting framework for which is designated generally by reference numeral 11 in FIG. 1. The sonar transducers (not shown) would be mounted within this framework in suitably disposed array to form the desired sonar transmit or receive patterns. Typically an array assembly such as the one shown would be perhaps 30 to 50 feet in each of its face dimensions and 5 to 8 feet in depth, and weigh 25 to 50 tons when fully fitted with the transducer elements which it is to carry.

The array 11 is suspended by a single main support line 13 from a surface platform shown as a ship 15 having a hold or well 17 into which the array 11 may be drawn upon retrieval as hereinafter explained. In the particular system being described the operating depth for the array may be one or more miles, and the need for such extreme length of cable poses definite limits on the diameter and tensile strength of cable which can be used with a working load of this magnitude. Additionally, this main support line typically has incorporated within it a number of electrical conductors, often a relatively large number, providing power and signal transmission to and from the submerged array when operating at depth. The inclusion of such electrical conductors within the cable tends to make it more fragile and prone to failure through electrical discontinuity in addition to the possibility of mechanical breakage due to overstress.

These problems are most acute during retrieval of the submerged object, since during launch the cable normally is paid out at a sufficiently rapid rate that the submerged object does not heavily load it, and during operation at the working depth there is sufficient of the main support line out that the resilience inherent in such long cable length effectively decouples the ship's motion from the lower portions of the cable and limits the transients in loading of the upper portions. Depending upon the sea state, however, the ship's heave and other motions may impose loading on the cable far in excess of its load capacity as the array is retrieved and hauled upwardly into proximity with the ship. The short length of cable then outstanding constrains the array to attempt to follow ship's motion and the forces generated in the process may become far greater than the normal load capability of the cable. Additionally, if the array is to be retrieved through an opening in the ship's hull and raised into a well or hold within the ship, as shown, the array must of course be properly oriented with respect to such opening and a single cable however strong can not provide this necessary orientation.

In accordance with the invention, retrieval of the array may readily and reliably be accomplished by use of a messenger device designated generally by reference numeral 19 in FIG. 1, which is lowered from the ship 15 to intercept the array 11 when it reaches a point approximately one or two hundred feet below the ship. Messenger 19 engages the array at that point to properly orient it with respect to the ship and at the same time to relieve the main support line at least partially of its loading. The messenger device is carried by two cables 21 and 23 respectively connected adjacent its opposite ends, with the upper ends of these cables being connected to suitably synchronized winches (not shown) carried within the ship's structure.

While the details of the messenger device and of its cooperative relation with the array are best shown in FIGS. 2–6 and will be described in reference to those figures, it may be noted in FIG. 1 that the messenger comprises a centering mechanism designated generally by reference numeral 25 which serves to maintain the messenger and array in approximate lateral alignment as the two approach each other on retrival, complementary ramp and follower means designated generally by reference numerals 27-29 and mounted to the messenger and array, respectively, for bringing them into angular alignment during retrieval, and latching mechanisms 31 disposed at opposite ends of the messenger and engaging correspondingly positioned bail elements 33 on the array 11 for locking them together. The general arrangement is such that as the array 11 and messenger 19 are brought into interengagement, either by lowering the messenger toward the array or by raising the array toward the messenger, the messenger centering mechanism 25 operates to hold the messenger and array roughly centered with respect to each other in the lateral sense, and any angular misalignment of the messenger and array is corrected by operation of the ramp and follower elements 27 and 29.

Ramp element 27 is of circular section and includes two similarly sloped camming surfaces each of which extends through 180°, and the follower includes two rollers spaced apart by the diameter of the circle defined by the ramp element. As shown, the camming surfaces and rollers are so disposed that gravity acts to effect any rotation of the array about its vertical axis needed to bring it into alignment with the messenger. When such alignment is achieved the latch devices 31 and 33 operate automatically to interlock the messenger and array together for subsequent hoisting of the resultant assembly by the messenger cables 21 and 23.

Figures 2, 3, 4A, 4B, 5, 6:
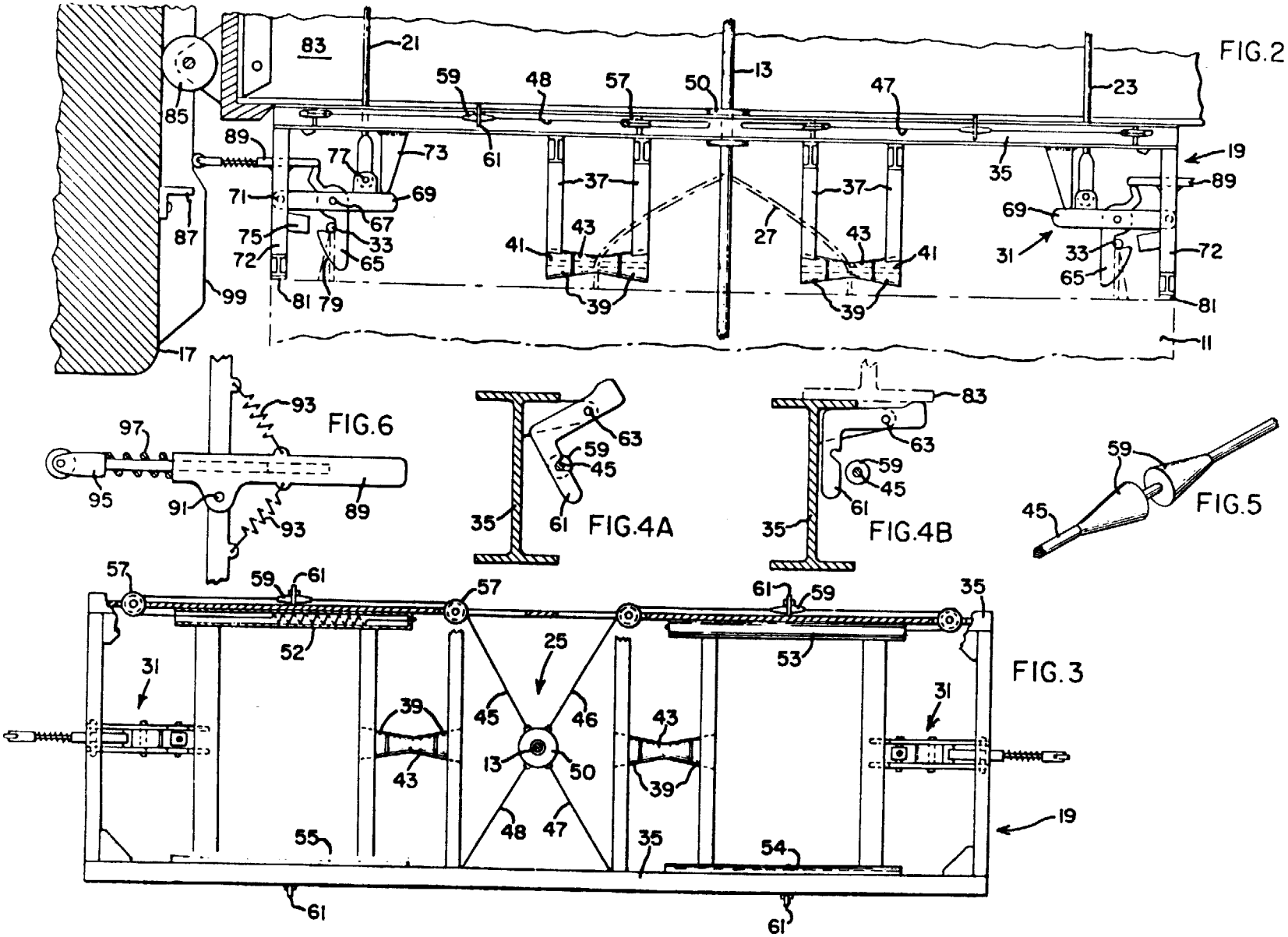
FIG. 2 is a side view, partially in section, illustrating the messenger device which forms part of the marine handling system of FIG. 1.
FIG. 3 is a top view, partially in section, of the messenger device.
FIGS. 4A and 4B are fragmentary views of latching elements which form part of the centering mechanism of the messenger device.
FIG. 5 is a fragmentary perspective of the cable stops which also form part of that centering mechanism.
FIG. 6 is a fragmentary perspective of the latch trip mechanism of the messenger device of FIG. 2.

Referring now to FIG. 2, the messenger 19 is shown to comprise a generally rectangular frame 35 from which depend two pairs of roller support brackets 37 each of which carries a roller support block 39 at its lower end. A shaft 41 having its opposite ends carried in the support blocks 39 of each bracket pair rotatably mounts a roller element 43, these rollers and their associated support blocks preferably being of the generally conical configuration shown to assist in operation of the centering mechanism next to be described.

As best seen in FIGS. 3-5, the centering mechanism 25 comprises four cables 45–48 each of which connects between a common centering ring 50 and one end of a tensioning spring the other end of which is connected to the messenger frame structure; one such spring is visible at 52 in FIG. 3 and the tubular housings for the others are indicated at 53-55. To enable the required distance of travel of these cables and springs within the available space, each of the cables preferably is provided with pulleys 57 to enable their being doubled back as shown. Each cable has fixed to it a pair of conical stops 59 (FIG. 5) spaced apart slightly so as to enable reception of a toggle member 61 between them. This toggle as best shown in FIGS. 4A and 4B comprises a crank shaped member pivotally mounted as at 63 to the messenger frame structure 35. Its shape is such that the toggle is urged by gravity to rotate into a position to engage one of the cables 45–48 and, when the stops 59 fixed to that cable pass beneath the toggle, to drop between them and thereafter prevent further movement of the cable with respect to the messenger frame structure. When all four toggles 61 have thus latched to their respective cables the centering ring 50 is held fixed in the centered position illustrated, and the centering ring will guide the messenger down the main support line in sufficiently good alignment with the array suspended thereby to assure satisfactory operation of the ramp and follower elements 27–29 and also of the latch mechanisms 31-33 next to be described.

Each of these latch mechanisms comprises a latch member 64 pivotally mounted as at 67 to a latch support lever 69 which is in turn pivotally mounted as at 71 between two latch support brackets 72 fixed to the messenger frame structure 35 as shown. Fixed stops 73 and 75 respectively limit the upward and downward rotation of the latch support lever 69, these stops being fixed to the messenger frame structure in any convenient manner. The messenger support cable 21 is pivotally attached to the latch support lever as at 77, with this point of attachment preferably being between the latch pivot axis at 67 and the stop 73 as shown.

The latch mechanisms are self-actuating into latching position as the messenger and array come together. As they do so, each latch pin or bail 33 carried by the array 11 will engage the camming surface 79 of one latch member 65 forcing the latch to rotate, counterclockwise in the case of the lefthand latch and clockwise in the case of the righthand one. The latch pin rides along this camming surface to its end and then drops into the latched position illustrated. Subsequently, as the messenger cables 21 and 23 are tensioned to hoist the assembly surfaceward, the upward pull on the latch support levers 69 serves to more securely engage the latches and, as the latch support levers 69 further rotate, the upward force on the array bail elements 33 will lift the array into engagement with the lower surfaces of the messenger frame structure, thus precluding any possibility of rocking or other relatively movement between the array and messenger during the hoist operation. Bumper pads 81 of rubber or other suitable resilient material may be interposed between the array and messenger to constrain any slight freedom of movement which might remain.

If it is desired that the object be retrieved into a well or hold within the surface vessel as in the illustrated embodiment, positioning of the messenger-array assembly within the well may be provided by a carriage device 83 as shown in FIG. 2. This carriage engages the messenger and array as they are drawn into the well 17 and guides them upwardly either for storage within the hull or topside for repair or other such operations. Carriage 83 is provided with suitable slides or rollers 85 as shown which travel along the bulkheads of well 17 or along vertically disposed guide rails mounted thereto, and its downward movement is limited by a fixed stop 87.

This carriage and well structure as shown also includes provision for automatic control of the messenger centering mechanism and latching devices. As the messenger is hoisted upwardly into engagement with carriage 83, the centering mechanism toggle members 61 contact the underside of the carriage and are pivoted out of engagement between the centering cable stops 59, thus disabling the centering mechanism so long as the messenger remains in this position.

For automatic unlock of the messenger latching devices 31, each is provided with a trip lever assembly comprising a lever member 89 pivotally mounted as at 91 (see FIG. 6) and biased by spring means 93 to a normally horizontal position as illustrated. A follower member 95 which is loaded by spring 97 outwardly with respect to the trip lever 91 engages a trip bar 99 mounted to the adjacent bulkhead of well 17 and is held in engagement therewith by its spring loading irrespective of any small motion of the messenger assembly with respect to the bulkhead. As will be apparent from inspection of FIG. 2, the operation of this latch mechanism is such that when the messenger assembly is being hoisted upwardly into the ship well, the trip lever 89 on striking the trip bar 99 will pivot away from the latch and will not affect it. As the messenger assembly moves downwardly through well 17 during a subsequent launch operation, however, and the trip lever 89 strikes the upper end of trip bar 99, the trip lever is rotated in a direction such that it acts to release the latch thus unlocking the array from the messenger.

While several different operating sequences are possible with the materials handling system of the present invention, the preferred procedure with a sonar array such as illustrated is to retain the messenger adjacent or within the ship hull during the launch operation, and to lower the array using only its main support line 13. As previously mentioned the loading on this cable during launch may be kept acceptably low by permitting a continuous and relatively rapid descent of the array, and after the array is launched and clears the ship there is no problem of their relative alignment.

After launch of the array, the messenger 19 preferably is retained within the ship's hull in engagement with the carriage 83. So long as this engagement continues, the lower frame members of carriage 83 will hold the centering device toggle members 61 in their unlocked position illustrated in FIG. 4B, permitting free play of the cables 45–48 with respect to the messenger frame. This permits the centering ring 50 to follow freely the movement of the main support line 13, with roll and pitch motion of the ship. In this way chafing and flexing of the main support line 13 at its point of contact with centering ring 50 is avoided during the periods when the array hangs suspended at its operating depth below the ship.

For retrieval of the array, the messenger device 19 is dropped downwardly by its support cables 21 and 23, and immediately upon its separation from carriage the centering device toggle members 61 are freed, permitting each to pivot into engagement with its respective centering cables 45–48. These cables now will be moving with the normal motion of the ship in roll and pitch, and within one or two cycles of those motions the stops 59 fixed to each of the centering cables will have moved into latching engagement with the associated toggle member 61, thus locking the centering ring 50 in its central position as illustrated in FIG. 3.

During the further descent of the messenger device 19 centering ring 50 will hold it centered with respect to the main support line 13, so that when the messenger and array come into engagement they will then be in sufficiently close lateral alignment to assure contact of the rollers 43 with the ramp 29, to thus enable this mechanism to rotate the array into angular alignment with the messenger. As such alignment is achieved the latches 31 lock to the bail elements 33 and the assembly thus formed then may be lifted by the messenger cables 21 and 23, the tensioning of which pivots the latch support levers 69 upwardly to firmly lock the array to the messenger for retrieval into the ship well or hold as previously explained.

As will be obvious to those skilled in the art, many modifications to the particular implementation illustrated are possible. For example, the several latching devices illustrated could be controlled manually rather than automatically as shown, and if desired the cooperating parts of the latch assemblies and of the ramp and roller assemblies could be reversed, with those parts shown mounted to the array being instead mounted to the messenger. Other modifications will occur to those skilled in the art and it should be understood that the appended claims are intended to cover all such modifications as fall within the true spirit and scope of the invention.

We claim:

1. For use in deploying and retrieving a submersible object suspended below a surface platform by a main support line depending therefrom, an object handling system comprising, in combination:

(a) a messenger device engaging said main support line and including centering means operable to maintain said messenger device in centered relationship with respect to said line when lowered thereon;

(b) messenger fit means including a plurality of messenger support cables, means carried by said surface platform for paying out and taking in said cables, and means attaching the lower ends of said cables to said messenger device at relatively widely spaced points thereon;

(c) guide means for angularly orienting said submersible object and said messenger device including a guide ramp element and a guide follower element, means mounting one of said guide elements to said object centrally with respect to its point of attachment to said main support line, and means mounting the other of said guide elements to said messenger device centrally with respect to its points of attachment to said support cables, whereby as said object and messenger device are brought into engagement by relative vertical movement said guide ramp and follower elements will rotate the object and messenger device into predetermined angular relationship with respect to each other; and (d) latch means carried by said object and said messenger device at locations symmetrically disposed with respect to said main support line and spaced therefrom, said latch means being operable upon attainment of said predetermined angular relationship between said object and said messenger device to lock them together for retrieval to said surface platform by lift of said messenger support cables.

2. An object handling system as defined in claim 1 wherein said centering means comprises a centering ring, a plurality of centering cables radiating therefrom, a like plurality of spring means each connecting one of said centering cables to said messenger, and a like plurality of cable lock means carried by said messenger and each operable to engage one of said centering cables between its associated spring means and said centering ring so as to lock said centering ring in fixed position with respect to said messenger frame.

3. An object handling system as defined in claim 1 wherein said ramp element is circular in section and includes a pair of similarly sloped camming surfaces each extending over 180° of the circle, and wherein said follower element comprises a pair of cam follower rollers with spacing between them corresponding to the circle diameter.

4. An object handling system as defined in claim 1 wherein each of said latch means comprises cooperating latch and pin elements, means fixing one of said elements to said submersible object, lever means mounted to said messenger device for pivotal movement about an axis and carrying the other of said latch and pin elements at a point removed from said pivot axis, and means fixing the lower end of one of said messenger support cables to said lever means at a point thereon such that upward force on the cable acts to raise said latch and pin elements with respect to said messenger device and thus bring said submersible object into more secure engagement therewith.

5. A marine equipment handling system for deploying and recovering a submersible object from an unstable surface platform comprising, in combination:

(a) a main support line attached centrally to said submersible object and adapted to suspend said object when deployed below said platform;

(b) a messenger including frame means and centering means adapted to travel along said main support line and maintain said messenger in generally centered relation with respect thereto;

(c) a plurality of messenger support cables and means attaching the lower ends thereof to said messenger frame at points thereon relatively widely spaced and symmetrically disposed with respect to said centering means;

(d) angular orientation guide means including a guide follower element and a guide ramp element having vertically sloping ramp surfaces, means mounting one of said guide elements to said object centrally with respect to its point of attachment to said main support line, and means mounting the other of said guide elements to said messenger centrally with respect to its points of attachment to said support cables, whereby as said object and messenger are brought into engagement by relative vertical movement said guide ramp and follower elements will rotate the object and messenger into predetermined angular relationship with respect to each other; and (e) a plurality of latch means each including a latch element and a pin element and means mounting one of said elements to said object and the other to said messenger at locations relatively widely spaced from and symmetrically disposed with respect to the points of attachment of said support line and cables, said latch means being operable upon attainment of said predetermined angular relationship between said object and messenger to lock them together for retrieval to said surface platform by lift of said messenger support cables.

6. An equipment handling system as defined in claim 5 further including means for selectively disabling said centering means except during retrieval operations.

7. An equipment handling system as defined in claim 5 further including lever means connecting one of said latch and pin elements to said messenger frame and to said messenger support cable so that upward force on the cable tends to lift said element upwardly with respect to the messenger.

* * * * *